US009977456B2

(12) United States Patent
Organ et al.

(10) Patent No.: US 9,977,456 B2
(45) Date of Patent: May 22, 2018

(54) MAGNETIC DETENTING CONFIGURATION FOR CUSTOM ENCODER

(71) Applicant: Advanced Input Devices, Inc., Coeur d'Alene, ID (US)

(72) Inventors: Kevin Vance Organ, Hayden, ID (US); Michael Ryan DeMartini, Coeur d'Alene, ID (US); Brandon Gregory Folk, Hayden, ID (US)

(73) Assignee: ADVANCED INPUT DEVICES, INC., Coeur d'Alene, ID (US)

( * ) Notice: Subject to any disclaimer, the term of this patent is extended or adjusted under 35 U.S.C. 154(b) by 196 days.

(21) Appl. No.: 14/699,835

(22) Filed: Apr. 29, 2015

(65) Prior Publication Data

US 2016/0320793 A1 Nov. 3, 2016

(51) Int. Cl.
*G05G 5/06* (2006.01)

(52) U.S. Cl.
CPC ..... *G05G 5/06* (2013.01)

(58) Field of Classification Search
CPC ..... G05G 5/00; G05G 5/06; G05G 5/065; G05G 5/12; G05G 5/26; G05G 2700/06; H03J 5/06; H03J 5/10; H01H 3/50; H01H 3/503; H01H 19/11; H01H 2003/506
See application file for complete search history.

(56) References Cited

U.S. PATENT DOCUMENTS 3,293,382 A 12/1966 Lewandowski et al.
4,346,269 A 8/1982 Slavin et al.
4,379,955 A 4/1983 Comerford
5,867,082 A * 2/1999 Van Zeeland ..... G01D 5/06 200/521
5,914,705 A 6/1999 Johnson et al.
6,578,447 B1 * 6/2003 Fraser ..... G05G 5/06 200/565
7,767,916 B2 * 8/2010 Kurihara ..... B60K 37/06 200/38 R
7,817,001 B2 * 10/2010 Kramlich ..... G05G 5/04 200/43.11

(Continued)

FOREIGN PATENT DOCUMENTS

DE 102008045232 A1 * 3/2010 ..... G05G 1/105
DE 202011100703 U1 * 7/2011 ..... H01H 19/11
FR 2908903 A1 * 5/2008 ..... G05G 5/06

*Primary Examiner* — Adam D Rogers
(74) *Attorney, Agent, or Firm* — Seed IP Law Group LLP

(57) ABSTRACT

Detent systems for rotary actuators that utilize one or more sets of magnets that have either attractive or repulsive characteristics. A biasing magnetic element may be positioned to repel a floating movable magnet. The repelled movable magnetic element is forced into contact with a serrated detenting ring via the repulsive force between magnets of common pole. As the detenting ring is rotated relative to the biasing magnet, the "floating" magnetic element is forced closer to the biasing magnet. The repulsive force drives the floating magnetic element into the next recess detent causing the rotational component to snap to the next detented position. The magnetic element rolls about its longitudinal axis as the magnetic element moves from one detent location to the next, which results in rolling friction that tends to cause significantly lower surface wear and increased life.

29 Claims, 6 Drawing Sheets

(56) References Cited

U.S. PATENT DOCUMENTS

| | | | | |
|---|---|---|---|---|
| 7,902,468 | B2 * | 3/2011 | Miyata | H01H 3/50 200/50.01 |
| 7,934,335 | B2 * | 5/2011 | Halverson | F41G 1/16 42/137 |
| 8,946,572 | B2 * | 2/2015 | Yang | H01H 19/11 200/11 R |
| 9,268,356 | B2 * | 2/2016 | Burleson | G05G 1/10 |
| 9,437,357 | B2 * | 9/2016 | Furuki | H01H 19/11 |
| 9,466,446 | B2 * | 10/2016 | Heimann | G05G 5/065 |
| 2010/0201467 | A1 * | 8/2010 | Hentschel | H01H 19/60 335/205 |
| 2012/0304802 | A1 | 12/2012 | Wall et al. | |
| 2016/0176292 | A1 * | 6/2016 | Blaesing | B60K 35/00 335/219 |

* cited by examiner

MAGNETIC DETENTING CONFIGURATION FOR CUSTOM ENCODER

BACKGROUND

Technical Field

The present disclosure generally relates to actuators.

Description of the Related Art

Detent systems may be generally found on the shafts of actuators, switches or controls, such as encoder devices (or "encoders"). Detent systems generally provide feedback in the form of haptic feedback and/or acoustic feedback by means of mechanical movement, thus ensuring that as the actuator is moved, the user "experiences" each individual movement from one latched position to the next. Often, an actuator purchased off the shelf has an electrical durability that far exceeds the mechanical durability of the detent system of the actuator.

As an example, some detent systems in rotary actuators make use of a spherical component, often a steel ball, which is biased by a spring (e.g., coil spring, torsion spring) against a serrated race or control surface that includes a number of valleys and hills. In the case of a rotary encoder, the serrated race may be capable of rotating with a shaft of the encoder. The spherical component may be restrained to move with only a single degree of freedom into or out of the valleys of the serrated race as the race is moved relative to the spherical component. These serrations when moved relative to the restraint of the spherical component, often about the central axis of the encoder, force the spherical component from one serration to the next causing a "snap" to occur that will index the encoder from one predetermined or stable position to a next predetermined position.

A problem with this style of detent system is that the friction between the spherical component and the serrated race is restricted to a point load which tends to wear relatively quickly causing erosion in the snap force of the detent system to the point of non-existence as typically the spherical ball erodes a path into the serrated detent race. This can be adjusted somewhat by spring force and detent race material selection, but the fundamental point load restriction cannot be superseded in these designs.

Alternate detent systems have been employed, such as compression leaf springs and bridged leaf springs, that have a linear contact characteristic, which improves the life expectancy of the detent system. However, since these types of detent systems still rely on contact friction to index from one detent location to the next detent location in an encoder, these types of detent systems still tend to wear against one another and erode the force of the detent system over time. These types of detent systems may also generate a larger quantity of debris in the process, potentially impairing the electrical functionality of the devices on which the detent systems are installed.

These shortcomings with contact related detent systems have led to the design of contactless magnetic detents. In such magnetic detent systems, one or more circular magnetic components with transverse strips of alternating polarity are coupled to either the shaft or the base (or both) of an encoder and rotated against a fixed (or moving) magnet. The repulsive and attractive forces between the two magnetic substrates allow for a non-contact detenting mechanism that should be capable of infinite life. A negative feature quality of these types of detent mechanisms is that magnetic detent systems may have insufficient tactile feedback and may tend to have a "mushy" feel when transitioning from one detent to another.

Another type of detent system for cylindrical controls utilizes a variable electromagnet approach which, in essence, uses a multi-winding motor to add detents to a shaft when turned. Similar to a stepper motor winding, these types of detent systems may selectively control the force in the system within the range between fixed (non-rotatable) to free spinning, dependent on the drive system and control mechanisms used. These detent systems, while still contactless, can offer superior variable detenting but are often cost prohibitive in a large-scale production environment. These types of detent system are also often relatively large in size, which is undesirable for many applications.

BRIEF SUMMARY

A detent system for a rotary actuator may be summarized as including: an annular detent ring having a control surface that includes a plurality of alternating peaks and valleys; a floating magnetic element positioned adjacent the annular detent ring in contact with the control surface of the annular detent ring; a floating magnetic element guide channel that restricts movement of the floating magnetic element while allowing the floating magnetic element to move radially inward and outward with respect to the annular detent ring; and a biasing magnetic element positioned proximate the annular detent ring, the biasing magnetic element and the annular detent ring rotatable with respect to one another, and a magnetic force between the biasing magnetic element and the floating magnetic element urges the floating magnetic element in a direction toward the control surface of the annular detent ring.

The magnetic force may be an attractive magnetic force. The magnetic force may be a repulsive magnetic force. The floating magnetic element may be cylindrical in shape. The floating magnetic element may be axially magnetized. The floating magnetic element may be cylindrical in shape, and rotation of the detent ring relative to the biasing magnetic element may cause the floating magnetic element to rotate along the control surface of the detent ring about a longitudinal axis of the floating magnetic element. The control surface of the detent ring may be positioned between the biasing magnetic element and the floating magnetic element. The floating magnetic element may be positioned between the control surface of the detent ring and the biasing magnetic element. At least one of the biasing magnetic element and the floating magnetic element may include a permanent magnetic element. At least one of the biasing magnetic element and the floating magnetic element may include a ferromagnetic material. The detent system may further include: a plurality of biasing magnetic elements positioned proximate the detent ring, the detent ring rotatable with respect to each of the biasing magnetic elements; and a plurality of floating magnetic elements, each of the plurality of floating magnetic elements aligned with one of the plurality of biasing magnetic elements, each of the plurality of floating magnetic elements in contact with the control surface of the detent ring and radially biased against the control surface by a magnetic force between the floating magnetic element and a respective one of the plurality of biasing magnetic elements. The plurality of biasing magnetic elements may be uniformly spaced around the detent ring.

A detent system for a rotary actuator may be summarized as including: a detent ring having a control surface; a biasing magnetic element positioned proximate the detent ring, the biasing magnetic element and the detent ring rotatable with respect to one another; a floating magnetic element positioned proximate the biasing magnetic element and adjacent the detent ring in contact with the control surface, the floating magnetic element cylindrical in shape and axially magnetized; and a magnetic element guide channel that restricts movement of the floating magnetic element while allowing the floating magnetic element to move radially inward and outward with respect to the detent ring; wherein a magnetic force between the biasing magnetic element and the floating magnetic element urges the floating magnetic element in a direction toward the control surface of the detent ring, and rotation of the detent ring relative to the biasing magnetic element causes the floating magnetic element to roll along the control surface of the detent ring about a longitudinal axis of the floating magnetic element.

The magnetic force may be an attractive magnetic force. The magnetic force may be a repulsive magnetic force. The control surface of the detent ring may be positioned between the biasing magnetic element and the floating magnetic element. The floating magnetic element may be positioned between the control surface of the detent ring and the biasing magnetic element. At least one of the biasing magnetic element and the floating magnetic element may include a permanent magnetic element. At least one of the biasing magnetic element and the floating magnetic element may include a ferromagnetic material. The detent system may further include: a plurality of biasing magnetic elements positioned proximate the detent ring, the detent ring rotatable with respect to each of the biasing magnetic elements; and a plurality of floating magnetic elements, each of the plurality of floating magnetic elements aligned with one of the plurality of biasing magnetic elements, each of the plurality of floating magnetic elements in contact with the control surface of the detent ring and radially biased against the control surface by a magnetic force between the floating magnetic element and a respective one of the plurality of biasing magnetic elements. The plurality of biasing magnetic elements may be uniformly spaced around the detent ring.

A detent system for an actuator may be summarized as including: a detent control component having a control surface that includes a plurality of alternating peaks and valleys; a floating magnetic element positioned adjacent the detent control component in contact with the control surface of the detent control component; a floating magnetic element guide channel that restricts movement of the floating magnetic element while allowing the floating magnetic element to move in a direction orthogonal to the control surface of the detent control component; and a biasing magnetic element positioned proximate the detent control component, the biasing magnetic element and the detent control component movable with respect to one another, and a magnetic force between the biasing magnetic element and the floating magnetic element urges the floating magnetic element in a direction toward the control surface of the detent control component.

The magnetic force may be an attractive magnetic force. The magnetic force may be a repulsive magnetic force. The floating magnetic element may be cylindrical in shape. The floating magnetic element may be axially magnetized. The floating magnetic element may be cylindrical in shape, and movement of the detent control component relative to the biasing magnetic element may cause the floating magnetic element to roll along the control surface of the detent control component about a longitudinal axis of the floating magnetic element. The control surface of the detent control component may be positioned between the biasing magnetic element and the floating magnetic element. The floating magnetic element may be positioned between the control surface of the detent control component and the biasing magnetic element. At least one of the biasing magnetic element and the floating magnetic element may include a permanent magnetic element. At least one of the biasing magnetic element and the floating magnetic element may include a ferromagnetic material. The detent system may further include: a plurality of biasing magnetic elements positioned proximate the detent control component, each of the biasing magnetic elements fixed with respect to one another, the detent control component movable with respect to each of the biasing magnetic elements; and a plurality of floating magnetic elements, each of the plurality of floating magnetic elements aligned with one of the plurality of biasing magnetic elements, each of the plurality of floating magnetic elements in contact with the control surface of the detent control component and biased against the control surface by a magnetic force between the floating magnetic element and a respective one of the plurality of biasing magnetic elements. The plurality of biasing magnetic elements may be uniformly spaced from each other. The actuator may be at least one of a rotary actuator or a linear actuator.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures and methods have not been shown or described in detail to avoid unnecessarily obscuring descriptions of the embodiments.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its broadest sense, that is, as meaning "and/or" unless the context clearly dictates otherwise.

The headings and Abstract of the Disclosure provided herein are for convenience only and do not interpret the scope or meaning of the embodiments.

Figure 1:
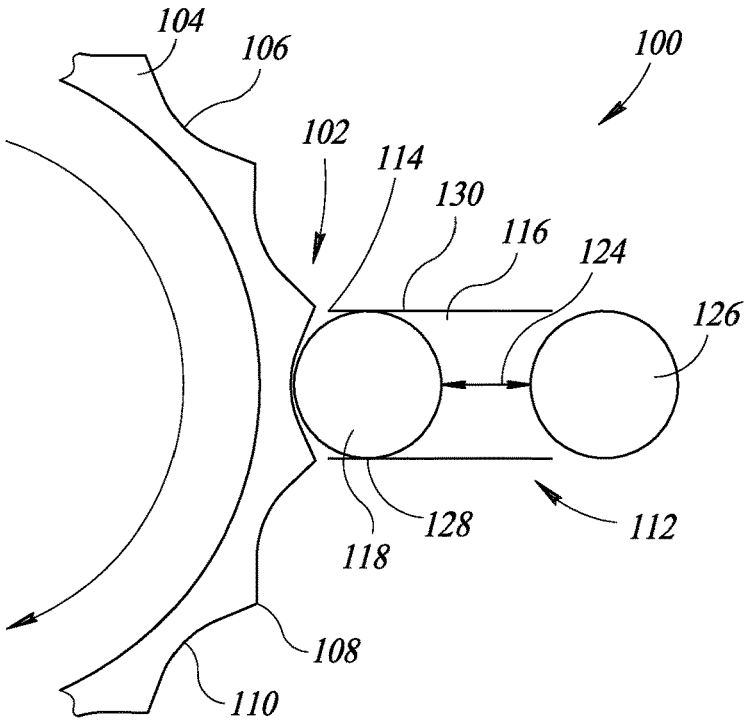
FIG. 1 is a schematic representation of a portion of a rotary actuator that includes a detent system, wherein a detent ring of the detent system is in a stable position, according to at least one illustrated embodiment.

FIG. 1 shows a portion of a rotary actuator 100 that includes a detent system 102 comprising a rotatable detent disk or ring 104 that includes an outward facing radial serrated race or control surface 106. The rotary actuator 100 may be an encoder, for example. The control surface 106 has an undulating profile and therefore has alternating peaks (or teeth) 108 and valleys (or detent recesses) 110. The detent ring 104 may rotate about an axis of a shaft (not shown) to which the detent ring is attached. During operation, a user may grip the shaft, or a component coupled to the shaft, to simultaneously rotate the shaft and the detent ring 104.

Figure 3:
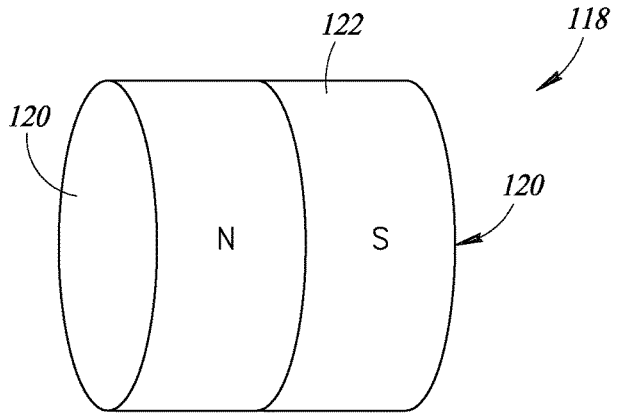
FIG. 3 is an isometric view of a magnetic detent element of the detent system of the rotary actuator of FIG. 1, according to at least one illustrated embodiment.

Proximate the control surface 106 of the rotatable detent ring 104 is a fixed guide channel 112 which has an open end 114 forming an aperture 116 in which a movable or "floating" detent element 118 is accommodated. The detent element 118 is magnetic and in some embodiments, is shaped in the form of a cylinder. FIG. 3 illustrates an example implementation of the detent element 118 formed as a cylindrically shaped permanent magnet having opposing circular faces 120 and a sidewall extending therebetween 122. In other implementations, the detent element 118 has a non-cylindrical shape which allows it to roll on a surface ("rolling shape"). In the illustrated implementation, the magnetic detent element 118 is axially magnetized (i.e., the North Pole N and the South Pole S of the detent element are located on the flat, circular faces 120 of the detent element), as opposed to diametrically magnetized.

Referring back to FIGS. 1 and 2, an inward radial force 124 is applied to the detent element 118 by a biasing magnetic element 126 positioned proximate the guide channel 112 radially outward therefrom with respect to the detent ring 104. The biasing magnetic element 126 is oriented so that the biasing magnetic element's north and south poles are aligned with the north and sound poles, respectively, of the detent element 118. The biasing magnetic element 126 may be a permanent magnet or a magnetized component (e.g., electromagnet). In this and other implementations, the biasing magnetic element 126 may be fixed or stationary, or may be movable. The biasing magnetic element 126 provides a repulsive force 124 to the movable detent element 118. The detent element 118 may move radially within the aperture 116 of the guide channel 112 and is urged or biased continuously in the direction of the control surface 106 of the detent ring 104 by the repulsive force 124 applied by the biasing magnetic element 126 due to the natural repulsive force between magnets of a common pole. The guide channel 112 may be sized to substantially allow only radial movement of the detent element 118 during operation. For example, the aperture 116 of the guide channel 112 may be bounded laterally by two sidewalls 128 and 130.

In the stable position shown in FIG. 1, the detent element 118 is in engagement with a detent recess 110 of the control surface 106, which is positioned directly radially inward from the aperture 116 of the guide channel 112. The detent element 118 may protrude from the open end 114 of the guide channel 112 in the direction of the control surface 106 of the detent ring 104.

Figure 2:
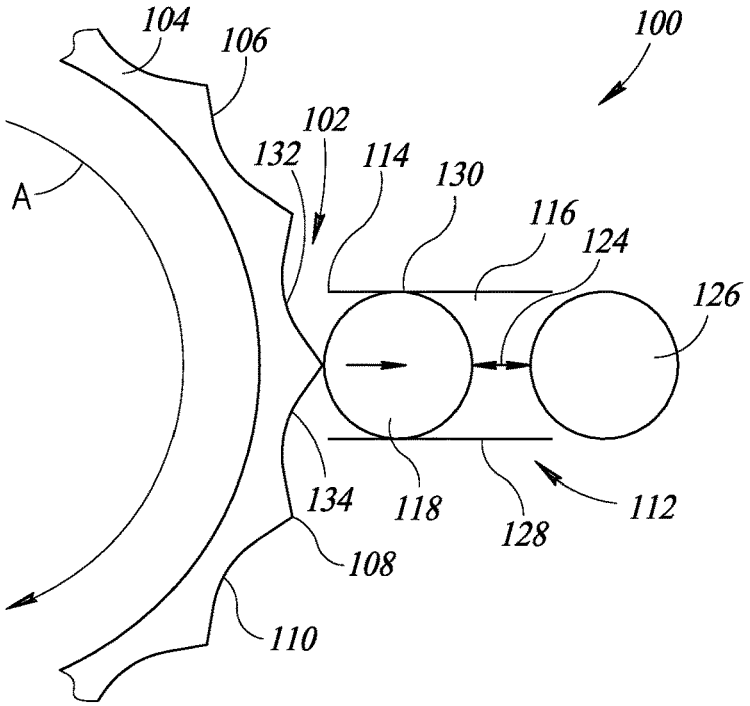
FIG. 2 is a schematic representation of the rotary actuator of FIG. 1 with the detent ring in an unstable position, according to at least one illustrated embodiment.

As shown in FIG. 2, the detent ring 104 may be rotated relative to the guide channel 112 as indicated by the arrow A, and a tooth or detent ring peak 108 is rotated into a region of the aperture 116 in the open end 114 of the guide channel 112. It is noted that either of the detent ring 104 or the guide channel 112 may rotate, so long as they are rotatable with respect to one another. The detent element 118 rolls up a rising tooth flank 132 of the tooth toward the tooth peak 108. Due to the direction of rotation of the detent ring 104, the detent element 118 is guided against the sidewall 128 of the guide channel 112 and at the same time is pushed into the aperture 116 against the repulsive force 124 of the biasing magnetic element 126. This reduction in distance between the detent element 118 and the biasing magnetic element 126 causes an increase in the repulsive force 124 between the two elements and is what determines the resistive breakover torque for the detent system 102.

The moment the detent element 118 reaches the tooth peak 108, as shown in FIG. 2, the detent element is in the position in which it is pushed furthest into the aperture 116 of the guide channel 112. A minimal further rotation of the detent ring 104 leads to the detent element 118 rolling past the tooth peak 108. Adjoining the tooth peak 108 is an opposite falling tooth flank 134. Due to the repulsive force 124 between the detent element 118 and the biasing magnetic element 126 causing forced rotation of the detent ring 104, there is an abrupt snap action in the form of a jump by the detent element after the detent element passes beyond the tooth peak 108. This abrupt forced rotation may cause a characteristic clicking noise to be produced, which provides acoustic feedback information to the user indicating a change in the detent position has occurred.

Additionally, after the detent element 118 has passed the tooth peak 108, as shown in FIG. 2, the repulsive force 124 between the detent element and the biasing magnetic element 126 cause the detent ring 104 to rotate further into the next detent recess 110 of the control surface 106 of the detent ring 104. This action provides haptic feedback to the user in addition to the acoustic feedback provided to the user. The intensity of the acoustic and haptic feedback may be adjusted during design by adjusting the mass of the detent element 118, the material of the detent element, the repulsive force 124 applied between the detent element and the biasing magnetic element 126, the shape of the control surface 106, etc.

In the case of rotation in the opposite direction, the same process as described above occurs, except the detent element 118 is moved and raised against the sidewall 130 by the respective tooth flank which the detent element traverses, and, when the detent element passes beyond a tooth peak 108, the detent element snaps due to forced rotation of the detent ring 104 in the opposite direction.

The quantity of teeth 108 and detent recesses 110 on the control surface 106 determines the angular rotation of the detent ring 104 required to transition from one stable position to the next. The detent system 102 is a contact-based detent system and may be prone to some of the wear out mechanisms described above. However, advantageously, since the cylindrical movable detent element 118 is not restrained about its longitudinal axis, the repulsive force 124 from the biasing magnet element 126 and the contact friction between the detent element and the control surface 106 of the detent ring 104 are sufficient to spin the detent element about its longitudinal axis as the detent element moves from one detent location to the next. This results in a characteristic that, rather than having a sliding friction constraint, there is rolling friction which tends to cause significantly lower surface wear and yields a longer lifetime for the detent system 102. Additionally, since the repulsive detent force 124 is directly proportional to the constrained distance between the movable detent element 118 and the biasing magnetic element 126, and the strength of their respective magnetic fields, the detenting force 124 can be easily adjusted or tuned to the desired behavior to match customer expectations by adjusting such distance and/or such strength of magnetic fields.

Multiple magnet sets of varying arrangements may be applied in similar fashion to meet specific requirements for a particular application such as a greater centering force, minimized hub wear, or minimized hysteresis. These variations include but are not limited to multiples of paired magnets (e.g., positioned rotationally symmetric about a shaft or asymmetric about a shaft). These variations may also include implementations that utilize a single moving magnet with paired repulsive magnets. The variations may also include use of multiple moving magnets with single biasing magnet, use of multiple paired magnets and ferrous elements, or any combinations of these variations.

Figure 4:
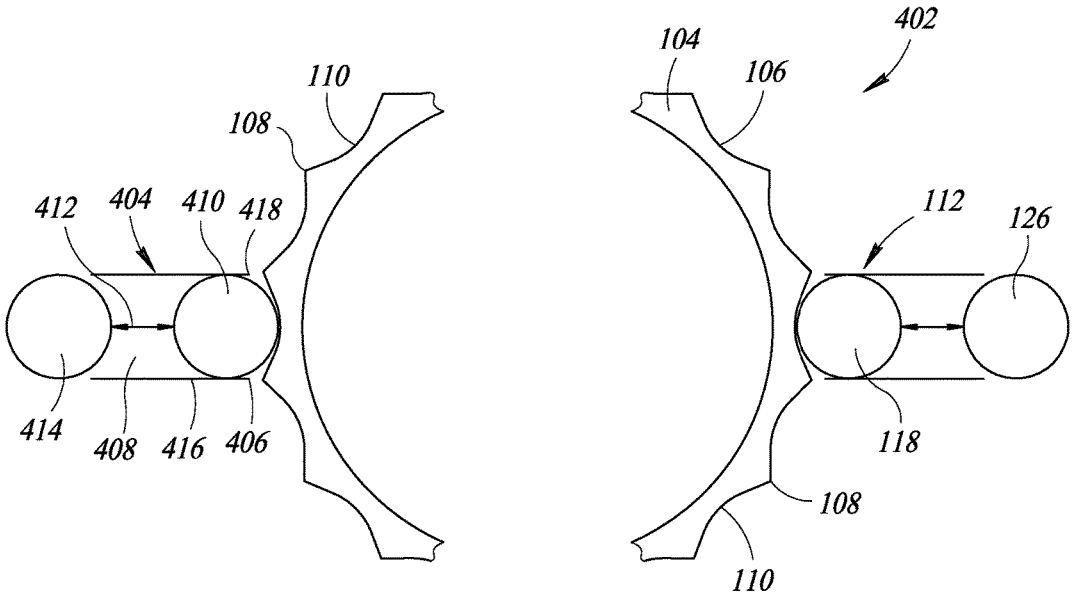
FIG. 4 is a schematic representation of a rotary actuator that includes a detent system having multiple detent elements, wherein a detent ring of the detent system is in a stable position, according to at least one illustrated embodiment.

For example, FIG. 4 shows another implementation of a detent system 400 for a rotary actuator 402. The detent system 400 is similar in many respects to the detent system 102 of FIGS. 1-2 discussed above, so a discussion of some of the similar components of the detent system 400 are not discussed here for the sake of brevity.

Proximate the control surface 106 of the rotatable detent ring 104 opposite the fixed guide channel 112 is a second fixed guide channel 404 which may be substantially the same as the first fixed guide channel 112. The second guide channel 404 has an open end 406 forming an aperture 408 in which a movable detent element 410 is accommodated. The detent element 410 is magnetic and in some embodiments, is shaped in the form of a cylinder (see the detent element 118 of FIG. 3). An inward radial force 412 is applied to the detent element 410 by a biasing magnetic element 414 positioned proximate the second guide channel 404 radially outward therefrom with respect to the detent ring 104. The biasing magnetic element 414 may be a permanent magnet or a magnetized component. The biasing magnetic element 414 provides the repulsive force 412 to the movable detent element 410. The detent element 410 may move radially within the aperture 408 of the second guide channel 404 and is urged or biased continuously in the direction of the control surface 106 of the detent ring 104 by the repulsive 412 force applied by the biasing magnetic element 414 due to the natural repulsive force between magnets of a common pole.

The second guide channel 404 may be sized to substantially allow only radial movement of the detent element 410 during operation. The aperture 408 of the second guide channel 404 may be bounded laterally by two sidewalls 416 and 418.

Although FIG. 4 shows a detent system 400 that includes two pairs of magnets positioned 180° apart from each other around the detent ring 104, in other implementations two or more sets of magnetic elements (e.g., 3 sets, 6 sets, 12 sets) may be positioned symmetrically or asymmetrically around the detent ring.

Figure 5:
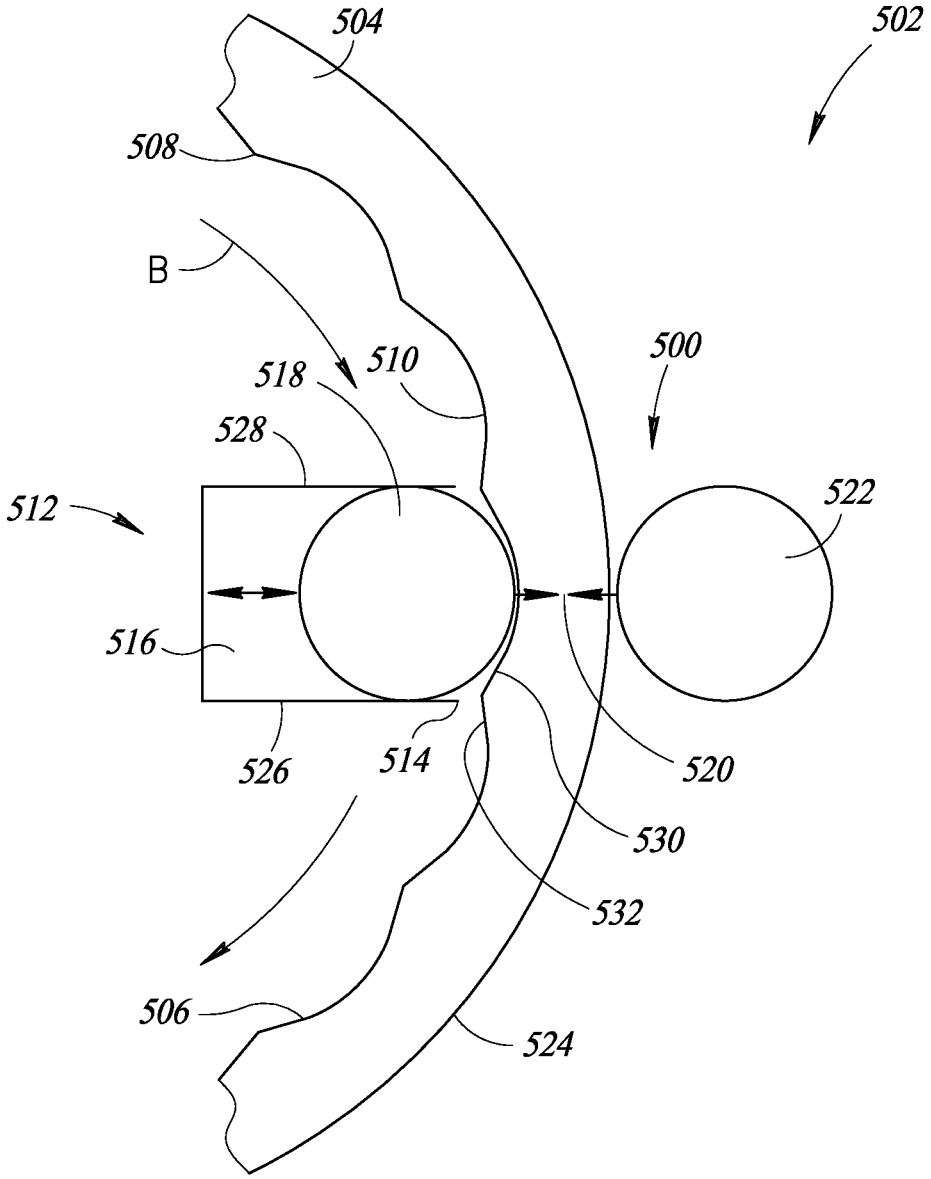
FIG. 5 is a schematic representation of a rotary actuator that includes a detent system having a detent ring with an inward facing control surface, according to at least one illustrated embodiment.

FIG. 5 shows another implementation of a detent system 500 for a rotary actuator 502, such as an encoder. In this implementation, the detent system 500 includes a rotatable detent disk or ring 504 that includes an inward facing radial serrated race or control surface 506. The control surface 506 has an undulating profile and therefore has alternating peaks (or teeth) 508 and valleys (or detent recesses) 510. The detent ring 504 may rotate relatively about an axis of a shaft (not shown) to which the detent ring is attached. During operation, a user may grip the shaft, or a component coupled to the shaft, to simultaneously rotate the shaft and the detent ring 504.

Proximate the control surface 506 of the rotatable detent ring 504 is a fixed guide channel 512 which has an open end 514 forming an aperture 516 in which a movable detent element 518 is accommodated. The detent element 518 is either magnetic or can be a permanent magnet and in some embodiments, is shaped in the form of a cylinder. The detent element 518 may be substantially similar to the detent element 118 of FIG. 3, for example. In the illustrated implementation, the magnetic detent element 518 is axially magnetized (i.e., the north and south poles of the detent element are located on the flat, circular faces of the element).

An outward radial force 520 is applied to the detent element 518 by a biasing magnetic element 522 positioned proximate the guide channel 512 radially outward therefrom proximate an outer surface 524 of the detent ring 504. Thus, the detent ring 504 is positioned between the movable detent element 518 and the biasing magnetic element 522. The biasing magnetic element 522 may be a permanent magnet or a magnetized component. The biasing magnetic element 522 may be fixed or may be movable. For example, in some implementations, the outer surface 524 may also be serrated to form a control surface, and the biasing magnetic element 522 may be movable so that the biasing magnetic element rolls along the control surface of the outer surface 524. That is, the biasing magnetic element 522 and the detent element 518 may each act as detent elements biased toward respective control surfaces by the attractive force between the two magnetic elements. As another example, in some implementations, if the poles are aligned correctly, multiple moving magnets may surround one or more central stationary magnets.

The biasing magnetic element 522 provides the attractive force 520 to the movable detent element 518. The detent element 518 may move radially within the aperture 516 of the guide channel 512 and is urged continuously in the direction of the control surface 506 of the detent ring 504 by the attractive force applied by the biasing magnetic element 522 due to the natural attractive force between magnets of opposite poles. The guide channel 512 may be sized to substantially allow only radial movement of the detent element 518 during operation. For example, the aperture 516 of the guide channel 512 may be bounded laterally by two sidewalls 526 and 528. In the stable position shown in FIG. 5, the detent element 518 is in engagement with a detent recess 510 of the control surface 506, which is positioned directly radially inward from the aperture 516 of the guide channel 512. The detent element 518 may protrude from the open end 514 of the guide channel 512 in the direction of the control surface 506 of the detent ring 504.

Similar to the operation of the detent system 102 discussed above with reference to FIG. 2, the detent ring 504 may be rotated relative to the guide channel 512 in the direction of an arrow B so that a tooth peak 508 is rotated into a region of the aperture 516 in the open end 514 of the guide channel 512. It is noted that either of the detent ring 504 or the guide channel 512 may rotate, so long as they are rotatable with respect to one another. The detent element 518 rolls up a rising tooth flank 530 of the tooth toward a tooth peak. Due to the direction of rotation of the detent ring 504, the detent element 518 is guided against the sidewall 526 of the guide channel 512 and at the same time is pushed into the aperture 516 against the attractive force 520 of the biasing magnetic element 522.

The moment the detent element 518 reaches the tooth peak 508, the detent element is in the position in which it is pushed furthest into the aperture 516. A minimal further rotation of the detent ring 504 leads to the detent element 518 rolling past the tooth peak 508. Adjoining the tooth peak 508 is an opposite falling tooth flank 532. Due to the attractive force 520 between the detent element 518 and the biasing magnetic element 522, there is an abrupt snap action in the form of a jump by the detent element after the detent element passes beyond the tooth peak 508. As discussed above, this abrupt change may cause acoustic feedback information and/or haptic feedback information to be provided to the user indicating a change in the detent position has occurred.

Although FIG. 5 shows a detent system that includes one pair of magnets around the detent ring 504, in other implementations two or more sets of magnetic elements (e.g., 3 sets, 6 sets, 12 sets) may be positioned symmetrically or asymmetrically around the detent ring.

Figure 6:
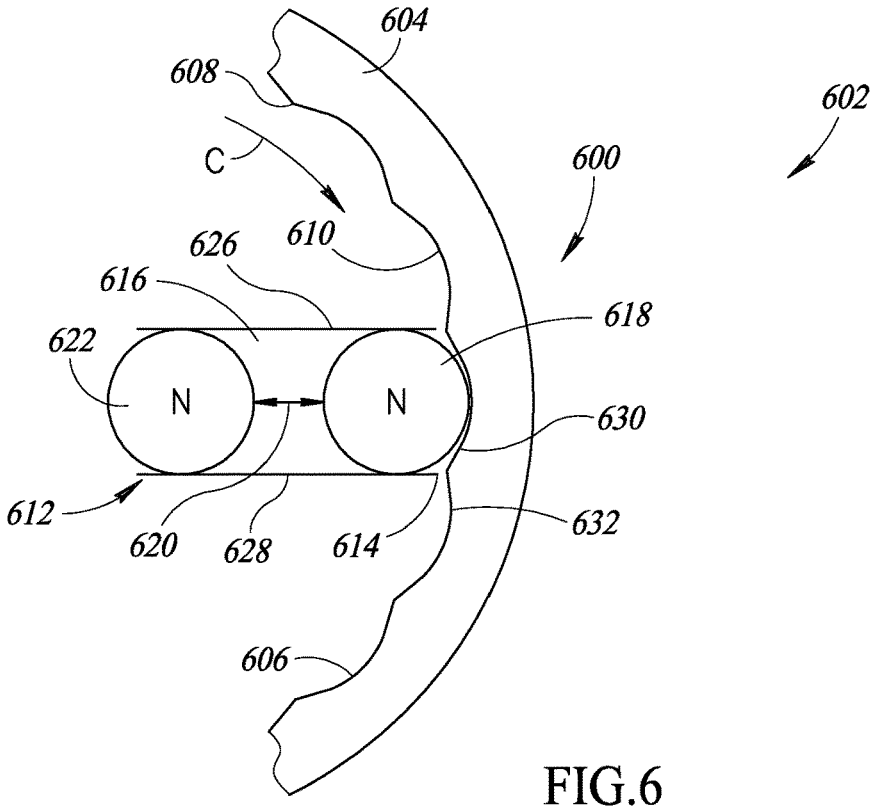
FIG. 6 is a schematic representation of a rotary actuator that includes a detent system having a detent ring with an inward facing control surface, according to at least one illustrated embodiment.

FIG. 6 shows another implementation of a detent system 600 for a rotary actuator 602, such as an encoder. The detent system 600 is similar in many respects to the detent systems 102 and 500 of FIGS. 1 and 5, respectively. In this implementation, the detent system 600 includes a rotatable detent disk or ring 604 that includes an inward facing radial serrated race or control surface 606. The control surface 606 has an undulating profile and therefore has alternating peaks (or teeth) 608 and valleys (or detent recesses) 610. The detent ring 604 may rotate relatively about an axis of a shaft (not shown) to which the detent ring is attached. During operation, a user may grip the shaft, or a component coupled to the shaft, to simultaneously rotate the shaft and the detent ring 604.

Proximate the control surface 606 of the rotatable detent ring 604 is a fixed guide channel 612 which has an open end 614 forming an aperture 616 in which a movable detent element 618 is accommodated. The detent element 618 is either magnetic or can be a permanent magnet and in some embodiments, is shaped in the form of a cylinder. The detent element 618 may be substantially similar to the detent element 118 of FIG. 3, for example. In the illustrated implementation, the magnetic detent element 618 is axially magnetized (i.e., the north and south poles of the detent element are located on the flat, circular faces of the element).

An outward radial force 620 is applied to the detent element 618 by a biasing magnetic element 622 positioned proximate the guide channel 612 radially inward therefrom. Thus, the movable detent element 618 is positioned between the control surface 606 of the detent ring 604 and the biasing magnetic element 622. The biasing magnetic element 622 may be a permanent magnet or a magnetized component. The biasing magnetic element 622 provides the repulsive force 620 to the movable detent element 618. The detent element 618 may move radially within the aperture 616 of the guide channel 612 and is urged continuously in the direction of the control surface 606 of the detent ring 604 by the repulsive force applied by the biasing magnetic element 622 due to the natural repulsive force between magnets of the same poles. The guide channel 612 may be sized to substantially allow only radial movement of the detent element 618 during operation. For example, the aperture 616 of the guide channel 612 may be bounded laterally by two sidewalls 626 and 628. In the stable position shown in FIG. 6, the detent element 618 is in engagement with a detent recess 610 of the control surface 606, which is positioned directly radially inward from the aperture 616 of the guide channel 612. The detent element 618 may protrude from the open end 614 of the guide channel 612 in the direction of the control surface 606 of the detent ring 604.

Similar to the operation of the detent system 102 discussed above with reference to FIG. 2, the detent ring 604 may be rotated relative to the guide channel 612 in the direction of an arrow C so that a tooth peak 608 is rotated into a region of the aperture 616 in the open end 614 of the guide channel 612. It is noted that either of the detent ring 604 or the guide channel 612 may rotate, so long as they are rotatable with respect to one another. The detent element 618 rolls up a rising tooth flank 630 of the tooth toward a tooth peak. Due to the direction of rotation of the detent ring 604, the detent element 618 is guided against the sidewall 626 of the guide channel 612 and at the same time is pushed into the aperture 616 against the repulsive force 620 of the biasing magnetic element 622.

The moment the detent element 618 reaches the tooth peak 608, the detent element is in the position in which it is pushed furthest into the aperture 616. A minimal further rotation of the detent ring 604 leads to the detent element 618 rolling past the tooth peak 608. Adjoining the tooth peak 608 is an opposite falling tooth flank 632. Due to the repulsive force 620 between the detent element 618 and the biasing magnetic element 622, there is an abrupt snap action in the form of a jump by the detent element after the detent element passes beyond the tooth peak 608. As discussed above, this abrupt change may cause acoustic feedback information and/or haptic feedback information to be provided to the user indicating a change in the detent position has occurred.

Although FIG. 6 shows a detent system that includes one pair of magnets around the detent ring 604, in other implementations two or more sets of magnetic elements (e.g., 3 sets, 6 sets, 12 sets) may be positioned symmetrically or asymmetrically around the detent ring.

Figure 7:
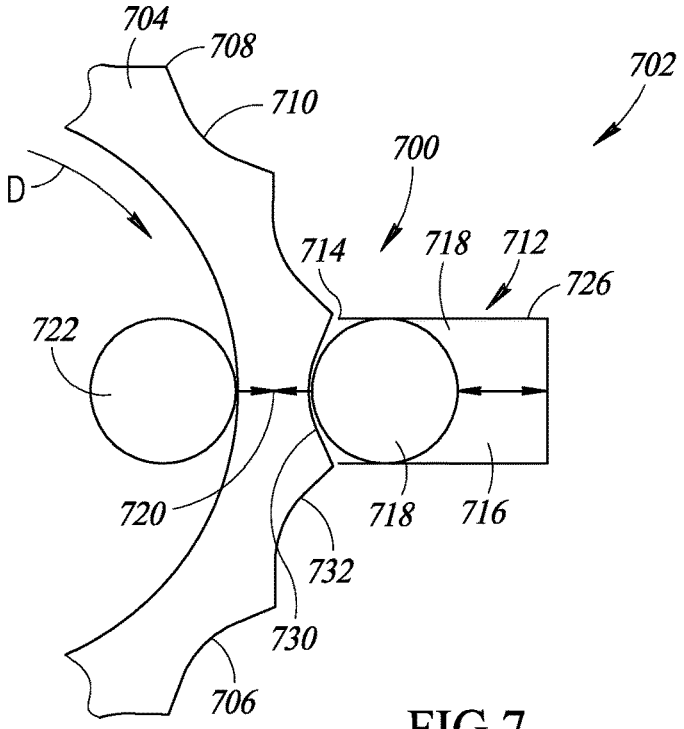
FIG. 7 is a schematic representation of a rotary actuator that includes a detent system having a detent ring with an outward facing control surface, according to at least one illustrated embodiment.

FIG. 7 shows another implementation of a detent system 700 for a rotary actuator 702, such as an encoder. In this implementation, the detent system 700 includes a rotatable detent disk or ring 704 that includes an outward facing radial serrated race or control surface 706. The control surface 706 has an undulating profile and therefore has alternating peaks (or teeth) 708 and valleys (or detent recesses) 710. The detent ring 704 may rotate relatively about an axis of a shaft (not shown) to which the detent ring is attached. During operation, a user may grip the shaft, or a component coupled to the shaft, to simultaneously rotate the shaft and the detent ring 704.

Proximate the control surface 706 of the rotatable detent ring 704 is a fixed guide channel 712 which has an open end 714 forming an aperture 716 in which a movable detent element 718 is accommodated. The detent element 718 is either magnetic or can be a permanent magnet and in some embodiments, is shaped in the form of a cylinder. The detent element 718 may be substantially similar to the detent element 118 of FIG. 3, for example. In the illustrated implementation, the magnetic detent element 718 is axially magnetized (i.e., the north and south poles of the detent element are located on the flat, circular faces of the element).

An inward radial force 720 is applied to the detent element 718 by a biasing magnetic element 722 positioned proximate the guide channel 712 radially inward therefrom. Thus, the detent ring 704 is positioned between the movable detent element 718 and the biasing magnetic element 722. The biasing magnetic element 722 may be a permanent magnet or a magnetized component. The biasing magnetic element 722 provides the attractive force 720 to the movable detent element 718. The detent element 718 may move radially within the aperture 716 of the guide channel 712 and is urged continuously in the direction of the control surface 706 of the detent ring 704 by the attractive force applied by the biasing magnetic element 722 due to the natural attractive force between magnets of the opposite poles. The guide channel 712 may be sized to substantially allow only radial movement of the detent element 718 during operation. For example, the aperture 716 of the guide channel 712 may be bounded laterally by two sidewalls 726 and 728. In the stable position shown in FIG. 7, the detent element 718 is in engagement with a detent recess 710 of the control surface 706, which is positioned directly radially inward from the aperture 716 of the guide channel 712. The detent element 718 may protrude from the open end 714 of the guide channel 712 in the direction of the control surface 706 of the detent ring 704.

Similar to the operation of the detent system 102 discussed above with reference to FIG. 2, the detent ring 704 may be rotated relatively in the direction of an arrow D so that a tooth peak 708 is rotated into a region of the aperture 716 in the open end 714 of the guide channel 712. It is noted that either of the detent ring 704 or the guide channel 712 may rotate, so long as they are rotatable with respect to one another. The detent element 718 rolls up a rising tooth flank 730 of the tooth toward a tooth peak. Due to the direction of rotation of the detent ring 704, the detent element 718 is guided against the sidewall 726 of the guide channel 712 and at the same time is pushed into the aperture 716 against the attractive force 720 of the biasing magnetic element 722.

The moment the detent element 718 reaches the tooth peak 708, the detent element is in the position in which it is pushed furthest into the aperture 716. A minimal further rotation of the detent ring 704 leads to the detent element 718 rolling past the tooth peak 708. Adjoining the tooth peak 708 is an opposite falling tooth flank 732. Due to the attractive force 720 between the detent element 718 and the biasing magnetic element 722, there is an abrupt snap action in the form of a jump by the detent element after the detent element passes beyond the tooth peak 708. As discussed above, this abrupt change may cause acoustic feedback information and/or haptic feedback information to be provided to the user indicating a change in the detent position has occurred.

Although FIG. 7 shows a detent system that includes one pair of magnets around the detent ring 704, in other implementations two or more sets of magnetic elements (e.g., 3 sets, 6 sets, 12 sets) may be positioned symmetrically or asymmetrically around the detent ring.

Figure 8A:
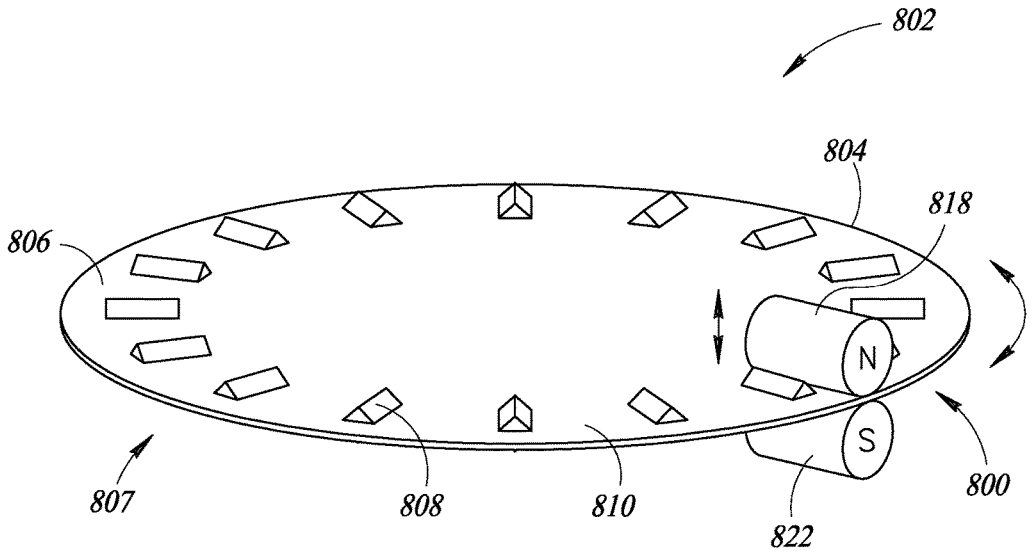
FIG. 8A is a schematic representation of a rotary actuator that includes a vertical detent system having a detent disk with an upward facing control surface, according to at least one illustrated embodiment.

FIG. 8A shows another implementation of a detent system 800 for a rotary actuator 802, such as an encoder. In this implementation, the detent system 800 includes a rotatable detent disk 804 that includes a top control surface 806 and a bottom surface 807 opposite the top surface. The top control surface 806 has alternating peaks (or teeth or bumps) 808 and valleys (or detent recesses) 810. The detent disk 804 may rotate relatively about an axis of a shaft (not shown) to which the detent disk is attached. During operation, a user may grip the shaft, or a component coupled to the shaft, to simultaneously rotate the shaft and the detent disk 804.

In the illustrated implementation, a movable detent element 818 is positioned on the top control surface 806 of the detent disk. The detent element 818 may be either magnetic or can be a permanent magnet and in some embodiments, is shaped in the form of a cylinder. The detent element 818 may be substantially similar to the detent element 118 of FIG. 3, for example. In the illustrated implementation, the magnetic detent element 818 is axially magnetized (i.e., the north and south poles of the detent element are located on the flat, circular faces of the element).

A downward force is applied to the detent element 818 by a biasing magnetic element 822 positioned below the bottom surface of the detent disk. Thus, the detent disk 804 is positioned between the movable detent element 818 and the biasing magnetic element 822. The biasing magnetic element 822 may be a permanent magnet or a magnetized component. The biasing magnetic element 822 provides the attractive force 820 to the movable detent element 818. The detent element 818 may move vertically within an aperture of a guide channel (not shown for clarity) and is urged continuously downward in the direction of the control surface 806 of the detent disk 804 by the attractive force applied by the biasing magnetic element 822 due to the natural attractive force between magnets of the opposite poles.

Similar to the operation of the detent systems discussed above, the movable magnetic element 818 may "roll" along the top control surface 806 of the detent disk 804 as the detent disk is rotated relative to the movable magnetic element. Due to the attractive force between the detent element 818 and the biasing magnetic element 822, there is an abrupt snap action in the form of a jump by the detent element after the detent element passes beyond one of the tooth peaks 808 and into the next detent recess 810. As discussed above, this abrupt change may cause acoustic feedback information and/or haptic feedback information to be provided to the user indicating a change in the detent position has occurred.

Although FIG. 8A shows a detent system that includes one set of magnets over and under the detent disk 804, in other implementations two or more sets of magnetic elements (e.g., 3 sets, 6 sets, 12 sets) may be positioned at various locations around the detent disk 804.

Figure 8B:
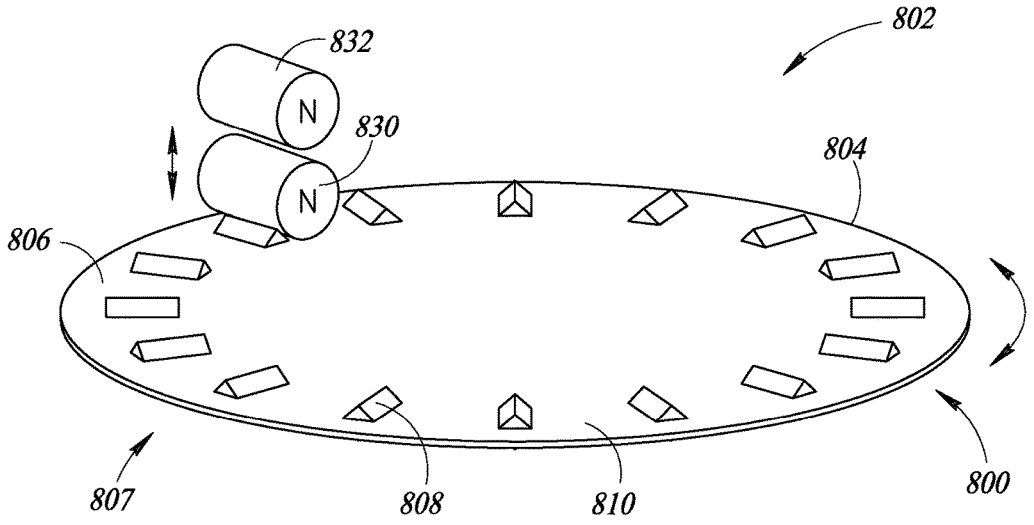
FIG. 8B is a schematic representation of a rotary actuator that includes a vertical detent system having a detent disk with an upward facing control surface, according to at least one illustrated embodiment.

FIG. 8B illustrates an implementation in which a movable magnetic element 830 positioned on the top control surface 806 of the detent disk 804. A downward force is applied to the movable detent element 830 by a biasing magnetic element 832 positioned above the movable detent element. Thus, the movable detent element 830 is positioned between the top control surface 806 of the detent disk 804 and the biasing magnetic element 832. The biasing magnetic element 832 may be a permanent magnet or a magnetized component. The biasing magnetic element 832 provides the repulsive force to the movable detent element 830. The detent element 830 may move vertically within an aperture of a guide channel (not shown for clarity) and is urged continuously in the direction of the top control surface 806 of the detent disk 804 by the repulsive force applied by the biasing magnetic element 832 due to the natural repulsive force between magnets of the same poles.

Similar to the operation of the detent systems discussed above, the movable magnetic element 830 may "roll" along the top control surface 806 of the detent disk 804 as the detent disk is rotated relative to the movable magnetic element. Due to the repulsive force between the detent element 830 and the biasing magnetic element 832, there is an abrupt snap action in the form of a jump by the detent element after the detent element passes beyond one of the tooth peaks 808 and into the next detent recess 810. As discussed above, this abrupt change may cause acoustic feedback information and/or haptic feedback information to be provided to the user indicating a change in the detent position has occurred.

Although FIG. 8B shows a detent system that includes one set of magnets over and under the detent disk 804, in other implementations two or more sets of magnetic elements (e.g., 3 sets, 6 sets, 12 sets) may be positioned at various locations around the detent disk 804.

Figure 9:
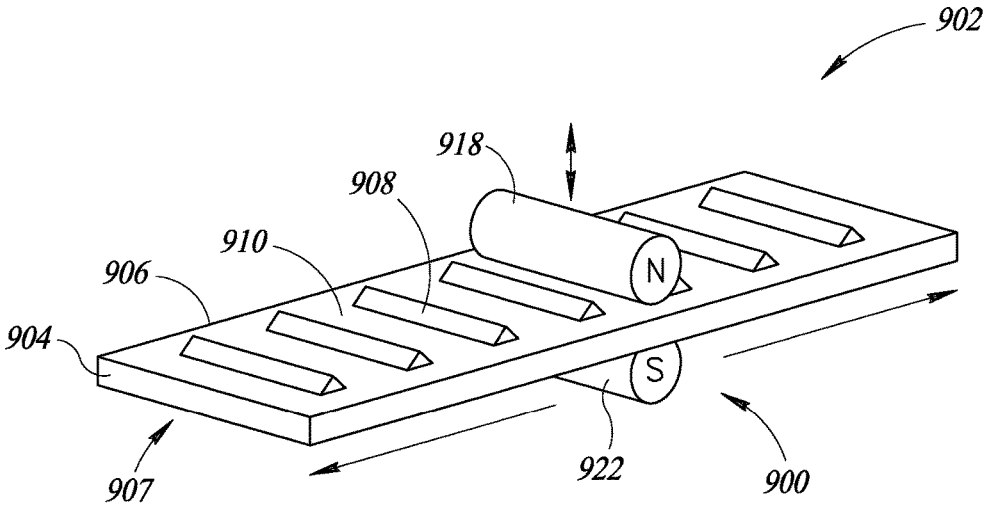
FIG. 9 is a schematic representation of a linear actuator that includes a detent system having a detent plate with an upward facing control surface, according to at least one illustrated embodiment.

FIG. 9 shows another implementation of a detent system 900 for a linear actuator 902, such as a linear slide potentiometer, for example. In this implementation, the detent system 900 includes a detent control component in the form of a plate 904 that includes a top control surface 906 and a bottom surface 907 opposite the top surface. The top control surface 906 has alternating peaks (or teeth or bumps) 908 and valleys (or detent recesses) 910. In some respects, the linear actuator 902 may be viewed as a rotary actuator having an infinite radius of curvature.

In the illustrated implementation, a movable detent element 918 is positioned on the top control surface of the detent plate 904. The detent element 918 may be either magnetic or can be a permanent magnet and in some embodiments, is shaped in the form of a cylinder. The detent element 918 may be substantially similar to the detent element 118 of FIG. 3, for example. In the illustrated implementation, the magnetic detent element 918 is axially magnetized (i.e., the north and south poles of the detent element are located on the flat, circular faces of the element).

A downward force is applied to the detent element 918 by a biasing magnetic element 922 positioned below the bottom surface 907 of the detent plate 904. Thus, the detent plate 904 is positioned between the movable detent element 918 and the biasing magnetic element 922. The biasing magnetic element 922 may be a permanent magnet or a magnetized component. In other implementations, the biasing magnet 922 may be positioned above the movable detent element 918 to apply a downward, repulsive force thereto. The biasing magnetic element 922 provides the attractive force to the movable detent element 918. The detent element 918 may move vertically within an aperture of a guide channel (not shown for clarity) and is urged continuously downward in the direction of the top control surface 906 of the detent plate 904 by the attractive force applied by the biasing magnetic element 922 due to the natural attractive force between magnets of the opposite poles. Similar to the operation of the detent systems discussed above, the movable magnetic element 918 may "roll" along the top control surface 906 of the detent plate 904 as the detent plate is linearly moved relative to the movable detent element. It is noted that either of the detent plate 904 or the detent element 918 may move linearly, so long as they are movable with respect to one another. Due to the attractive force between the detent element 918 and the biasing magnetic element 922, there is an abrupt snap action in the form of a jump by the detent element after the detent element passes beyond one of the tooth peaks 908 and into the next detent recess 910. As discussed above, this abrupt change may cause acoustic feedback information and/or haptic feedback information to be provided to the user indicating a change in the detent position has occurred.

Although FIG. 9 shows a detent system that includes one set of magnets over and under the detent plate 904, in other implementations two or more sets of magnetic elements (e.g., 3 sets, 6 sets, 12 sets) may be positioned along the length and/or width of the detent plate 904.

The magnetic elements described herein may comprise any material or object that produces a magnetic field and/or ferromagnetic materials (e.g., ferrous slugs). For example, in some implementations one or more of the magnetic elements are permanent magnets that create their own persistent magnetic field. Such permanent magnets may be made paired with other permanent magnets or with other ferromagnetic materials. Permanent magnets may be made from one or more ferromagnetic materials, such as iron, nickel, cobalt, alloys of rare earth metals, naturally occurring minerals, such as lodestone, etc. In some implementations, one or more of the magnetic elements may include an electromagnet. Generally, an electromagnet is made from a coil of wire that acts as a magnet when an electric current passes through it but stops being a magnet when the current stops. The coil may be wrapped around a core of "soft" ferromagnetic material such as steel, which enhances the magnetic field produced by the coil.

It should be appreciated that although the examples discussed above and shown in the figures utilize linear or circular detent paths, the functionality disclosed herein may be implemented with numerous other types of detent paths. For example, a conical detent path, like that of a bevel gear merit inclusion, or an irregular path with twist, turn and elevation change, like that of a belt or track, may be implemented. Those skilled in the art will appreciate the variations of detent paths that may be utilized.

Further, although in some implementations the magnetic elements may be cylindrical, other shapes may also be used. Fundamentally, the floating magnetic element may be any shape that allows for rolling and, in repelling instances, may also be polarized. For example, other shapes that fulfill the rolling and magnetic aspects include hourglass shapes or shapes that become relatively thin at their poles. Conversely, a non-rolling or biasing magnetic element can be any shape as long as its field poles or field affected mass (ferrous) is aligned to the approximate center of the rolling magnetic element.

The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of components, or virtually any combination thereof.

Those skilled in the art will recognize that many of the methods or algorithms set out herein may employ additional acts, may omit some acts, and/or may execute acts in a different order than specified.

The various embodiments described above can be combined to provide further embodiments. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A detent system for a rotary actuator, the detent system comprising:

an annular detent ring having a control surface that includes a plurality of alternating peaks and valleys;

at least one floating magnetic element positioned adjacent the annular detent ring in contact with the control surface of the annular detent ring;

a guide channel that restricts movement of the at least one floating magnetic element while allowing the at least one floating magnetic element to move radially inward and outward with respect to the annular detent ring; and at least one biasing magnetic element positioned proximate the annular detent ring, the at least one biasing magnetic element and the annular detent ring rotatable with respect to one another, and a magnetic force between the at least one biasing magnetic element and the at least one floating magnetic element urges the at least one floating magnetic element in a direction toward the control surface of the annular detent ring, wherein the at least one floating magnetic element is cylindrical in shape, and rotation of the detent ring relative to the at least one biasing magnetic element causes the at least one floating magnetic element to roll along the control surface of the detent ring about a longitudinal axis of the at least one floating magnetic element.

2. The detent system of claim 1 wherein the magnetic force is an attractive magnetic force.

3. The detent system of claim 1 wherein the magnetic force is a repulsive magnetic force.

4. The detent system of claim 1 wherein the control surface of the detent ring is positioned between the at least one biasing magnetic element and the at least one floating magnetic element.

5. The detent system of claim 1 wherein the at least one floating magnetic element is positioned between the control surface of the detent ring and the at least one biasing magnetic element.

6. The detent system of claim 1 wherein at least one of the at least one biasing magnetic element and the at least one floating magnetic element includes a permanent magnetic element.

7. The detent system of claim 1 wherein at least one of the at least one biasing magnetic element and the at least one floating magnetic element includes a ferromagnetic material.

8. The detent system of claim 1 wherein the at least one biasing magnetic element comprises a plurality of biasing magnetic elements positioned proximate the detent ring, the detent ring rotatable with respect to each of the biasing magnetic elements, and wherein the at least one floating magnetic element comprises a plurality of floating magnetic elements, each of the plurality of floating magnetic elements aligned with one of the plurality of biasing magnetic elements, each one of the plurality of floating magnetic elements in contact with the control surface of the detent ring and radially biased against the control surface by a magnetic force between the one of the floating magnetic elements and a respective one of the plurality of biasing magnetic elements.

9. The detent system of claim 8 wherein the plurality of biasing magnetic elements are uniformly spaced around the detent ring.

10. A detent system for a rotary actuator, the detent system comprising:

a detent ring having a control surface;

at least one biasing magnetic element positioned proximate the detent ring, the at least one biasing magnetic element and the detent ring rotatable with respect to one another;

at least one floating magnetic element positioned proximate the at least one biasing magnetic element and adjacent the detent ring in contact with the control surface, the at least one floating magnetic element is cylindrical in shape and axially magnetized; and a guide channel that restricts movement of the at least one floating magnetic element while allowing the at least one floating magnetic element to move radially inward and outward with respect to the detent ring;

wherein a magnetic force between the at least one biasing magnetic element and the at least one floating magnetic element urges the at least one floating magnetic element in a direction toward the control surface of the detent ring, and rotation of the detent ring relative to the at least one biasing magnetic element causes the at least one floating magnetic element to roll along the control surface of the detent ring about a longitudinal axis of the at least one floating magnetic element.

11. The detent system of claim 10 wherein the magnetic force is an attractive magnetic force.

12. The detent system of claim 10 wherein the magnetic force is a repulsive magnetic force.

13. The detent system of claim 10 wherein the control surface of the detent ring is positioned between the at least one biasing magnetic element and the at least one floating magnetic element.

14. The detent system of claim 10 wherein the at least one floating magnetic element is positioned between the control surface of the detent ring and the at least one biasing magnetic element.

15. The detent system of claim 10 wherein at least one of the at least one biasing magnetic element and the at least one floating magnetic element includes a permanent magnetic element.

16. The detent system of claim 10 wherein at least one of the at least one biasing magnetic element and the at least one floating magnetic element includes a ferromagnetic material.

17. The detent system of claim 10 wherein the at least one biasing magnetic element comprises a plurality of biasing magnetic elements positioned proximate the detent ring, the detent ring rotatable with respect to each of the biasing magnetic elements, and wherein the at least one floating magnetic element comprises a plurality of floating magnetic elements, each of the plurality of floating magnetic elements aligned with one of the plurality of biasing magnetic elements, each one of the plurality of floating magnetic elements in contact with the control surface of the detent ring and radially biased against the control surface by a magnetic force between the one of the floating magnetic elements and a respective one of the plurality of biasing magnetic elements.

18. The detent system of claim 17 wherein the plurality of biasing magnetic elements are uniformly spaced around the detent ring.

19. A detent system for an actuator, the detent system comprising:

a detent control component having a control surface that includes a plurality of alternating peaks and valleys;

at least one floating magnetic element positioned adjacent the detent control component in contact with the control surface of the detent control component;

a guide channel that restricts movement of the at least one floating magnetic element while allowing the at least one floating magnetic element to move in a direction orthogonal to the control surface of the detent control component; and at least one biasing magnetic element positioned proximate the detent control component, the at least one biasing magnetic element and the detent control component movable with respect to one another, and a magnetic force between the at least one biasing magnetic element and the at least one floating magnetic element urges the at least one floating magnetic element in a direction toward the control surface of the detent control component, wherein the at least one floating magnetic element is cylindrical in shape, and movement of the detent control component relative to the at least one biasing magnetic element causes the at least one floating magnetic element to roll along the control surface of the detent control component about a longitudinal axis of the at least one floating magnetic element.

20. The detent system of claim 19 wherein the magnetic force is an attractive magnetic force.

21. The detent system of claim 19 wherein the magnetic force is a repulsive magnetic force.

22. The detent system of claim 19 wherein the at least one floating magnetic element is axially magnetized.

23. The detent system of claim 19 wherein the control surface of the detent control component is positioned between the at least one biasing magnetic element and the at least one floating magnetic element.

24. The detent system of claim 19 wherein the at least one floating magnetic element is positioned between the control surface of the detent control component and the at least one biasing magnetic element.

25. The detent system of claim 19 wherein at least one of the at least one biasing magnetic element and the at least one floating magnetic element includes a permanent magnetic element.

26. The detent system of claim 19 wherein at least one of the at least one biasing magnetic element and the at least one floating magnetic element includes a ferromagnetic material.

27. The detent system of claim 19 wherein the at least one biasing magnetic element comprises a plurality of biasing magnetic elements positioned proximate the detent control component, each of the biasing magnetic elements fixed with respect to one another, the detent control component movable with respect to each of the biasing magnetic elements, and wherein the at least one floating magnetic element comprises a plurality of floating magnetic elements, each of the plurality of floating magnetic elements aligned with one of the plurality of biasing magnetic elements, each one of the plurality of floating magnetic elements in contact with the control surface of the detent control component and biased against the control surface by a magnetic force between the one of the floating magnetic elements and a respective one of the plurality of biasing magnetic elements.

28. The detent system of claim 27 wherein the plurality of biasing magnetic elements are uniformly spaced from each other.

29. The detent system of claim 27 wherein the actuator is at least one of a rotary actuator or a linear actuator.

* * * * *